US005195489A

United States Patent [19]

Reich

[11] Patent Number: 5,195,489

[45] Date of Patent: Mar. 23, 1993

[54] PUSH RODS FOR PISTONS IN COMPRESSION RELEASE ENGINE RETARDERS

[75] Inventor: Steven A. Reich, Simsbury, Conn.

[73] Assignee: Jacobs Brake Technology Corporation, Wilmington, Del.

[21] Appl. No.: 816,664

[22] Filed: Jan. 3, 1992

[51] Int. Cl.[5] ..... F01L 1/14; F01L 13/06; F02D 9/06

[52] U.S. Cl. ..... 123/321; 123/323; 123/90.61

[58] Field of Search ..... 123/90.16, 90.61, 320, 123/321, 322, 323, 347, 348

[56] References Cited

U.S. PATENT DOCUMENTS

| | | | |
|---|---|---|---|
| 2,882,877 | 4/1959 | Dierksen | 123/90.61 |
| 4,473,047 | 9/1984 | Jakuba et al. | 123/323 |
| 4,721,074 | 1/1988 | Wirth et al. | 123/90.23 |
| 4,773,360 | 9/1988 | Heimburg | 123/90.23 |
| 4,793,307 | 12/1988 | Quenneville et al. | 123/323 |
| 4,856,474 | 8/1989 | Tisch | 123/323 |
| 4,864,983 | 9/1989 | Breitbarth | 123/90.61 |
| 5,036,810 | 8/1991 | Meneely | 123/321 |

FOREIGN PATENT DOCUMENTS

| | | | |
|---|---|---|---|
| 147384 | 4/1981 | Fed. Rep. of Germany | 123/90.61 |

*Primary Examiner*—Willis R. Wolfe
*Attorney, Agent, or Firm*—Robert R. Jackson

[57] ABSTRACT

In a compression release engine retarder of the type in which the reciprocating motion of a hydraulic piston in the retarder is coupled to arcuate motion of a point on a pivoting element in the associated engine by a push rod between the piston and the pivoting element, the end of the push rod in contact with the piston is made convex and the piston surface contacted by the push rod is made flat so that the convex push rod surface rolls on the flat piston surface. This rolling motion replaces sliding motion in the prior art, thereby reducing or eliminating the need for expensive surface treatments and/or lubrication.

15 Claims, 4 Drawing Sheets

PUSH RODS FOR PISTONS IN COMPRESSION RELEASE ENGINE RETARDERS

BACKGROUND OF THE INVENTION

This invention relates to compression release engine brakes or retarders, and more particularly to the push rods used with the hydraulic pistons in such apparatus.

Engine brakes or retarders of the compression release type are well known as shown, for example, by Jakuba et al U.S. Pat. No. 4,473,047. In such engine retarders one or more exhaust valves in one or more cylinders of the associated internal combustion engine are opened near top dead center of the compression stroke of the cylinder when the retarder is in operation and the fuel supply to the engine is accordingly cut off. This allows the air compressed during the compression stroke of the cylinder to escape before at least a major portion of the work of compression is recovered during the subsequent power stroke of that cylinder.

In the typical compression release engine retarder the force required to open the exhaust valves as described above is typically derived from another part of the associated engine such as an intake valve push rod, rocker arm, or fuel injector push rod of another cylinder. This mechanical input is picked up by a master piston in a hydraulic circuit in the engine retarder and transmitted to a slave piston via that circuit. The resulting motion of the slave piston is used to open the exhaust valve of the cylinder which is nearing top dead center of its compression stroke. A push rod is typically used to couple the motion of the input element to the master piston, and another push rod is used to couple the motion of the slave piston to the exhaust valve or valves to be opened.

In many engines the mechanical input and/or output elements are rocker arms contacted by one end of the above-mentioned master and/or slave piston push rods. Because the end of such a push rod which is in contact with the rocker arm is moving along a circular arc, while the other end (in contact with the master or slave piston) is constrained to reciprocate linearly with the master or slave piston, both ends of the push rod must slide in associated sockets in order to accommodate the different types of motion experienced by the ends. To minimize wear on such surfaces which are in sliding contact with one another, it is generally necessary for the mating surfaces to be ground and polished. Good lubrication of such surfaces is also helpful to reduce wear. At the master or slave piston end of such push rods, however, the push rod may be deeply recessed in the piston. It is therefore difficult and/or costly to grind and polish the master or slave piston surface which is in contact with the push rod. The recessed nature of this surface also makes it difficult to lubricate it.

In view of the foregoing, it is an object of this invention to improve and simplify push rods and the associated elements of compression release engine retarders.

It is a more particular object of this invention to reduce or eliminate the need for grinding and polishing, as well as the need for lubrication, of the surfaces on at least one end of push rods in compression release engine retarders.

SUMMARY OF THE INVENTION

These and other objects of the invention are accomplished in accordance with the principles of the invention by shaping at least the end of a compression release engine retarder push rod which is recessed in a master or slave piston so that it is convex with a relatively large radius. The mating surface of the master or slave piston can then be made flat, and the convex push rod surface rolls (rather than slides) on the flat master or slave piston surface. Because the contact is now rolling rather than sliding, the surfaces do not have to be ground and polished. The need for lubrication is also reduced.

Further features of the invention, its nature and various advantages will be more apparent from the accompanying drawings and the following detailed description of the preferred embodiments.

DETAILED DESCRIPTION OF THE PREFERRED EMBODIMENTS

Although the principles of this invention are equally applicable to master piston push rods for compression release engine retarders, the invention will be fully understood from the following description of its application to slave piston push rods for such retarders.

Figure 1:
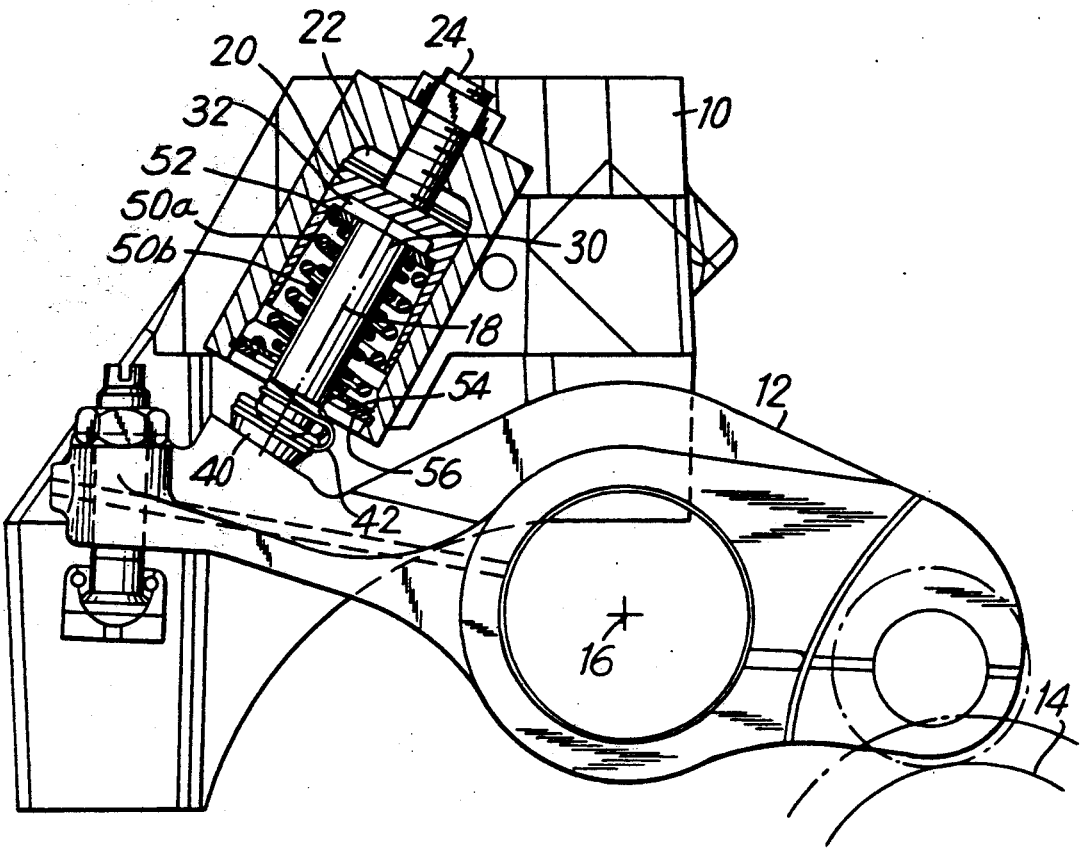
FIG. 1 is a simplified cross sectional view of part of a compression release engine retarder constructed in accordance with the principles of this invention, together with part of an associated internal combustion engine.

As shown in FIG. 1, an illustrative compression release engine retarder 10 is mounted on an associated internal combustion engine above the rocker arms of that engine. FIG. 1 shows a representative exhaust valve rocker arm 12 and the associated slave piston 20 in retarder 10. Slave piston 20 is disposed for reciprocation along axis 18 in slave piston cylinder 22 and has a lash adjusting screw 24 for adjusting the starting point of the slave piston's stroke. In FIG. 1 slave piston 20 is shown in the starting position, and rocker arm 12 is shown undisplaced by either the associated engine cam 14 or by piston 20.

The under side of piston 20 is recessed to receive the upper portion of push rod 30. The lower end of push rod 30 carries a foot 40. Foot 40 has a socket which mates with a ball shape on the lower end of push rod 30. Foot 40 is resiliently held to rod 30 by a spring metal retainer clip 42 which is wound around both an annular recess in rod 30 and an annular recess in foot 40. Accordingly, foot 40 is able to pivot by a limited amount on its ball and socket joint with the lower end of push rod 30. The bottom surface of foot 40 bears on a surface on rocker arm 12.

Slave piston 20 is resiliently urged to move in the upward direction in cylinder 22 by a pair of frustoconical, prestressed, compression coil springs **50*a* and 50*b* which concentrically surround the major portion of push rod 30. The upper ends of springs 50 bear on washer 52 which spans a radially inwardly projecting annular shoulder on piston 20 and a radially outwardly projecting flange 32 on the upper end of push rod 30. The lower ends of springs 50 bear on another washer 54. Washer 54 bears in turn on a retainer ring 56** which snaps into an annular recess in the side wall of cylinder 22. In addition to resiliently urging piston 20 to move upward in cylinder 22, springs 50 tend to keep the longitudinal axis of push rod 30 resiliently aligned with the reciprocation axis 18 of piston 20. This keeps foot 40 aimed at the proper spot on rocker arm 12 while foot 40 is out of contact with the rocker arm. However, springs 50 do not prevent push rod 30 from pivoting slightly out of alignment with axis 18 when rocker arm 12 is pushed down by operation of slave piston 20 is described in more detail below.

Figure 2:
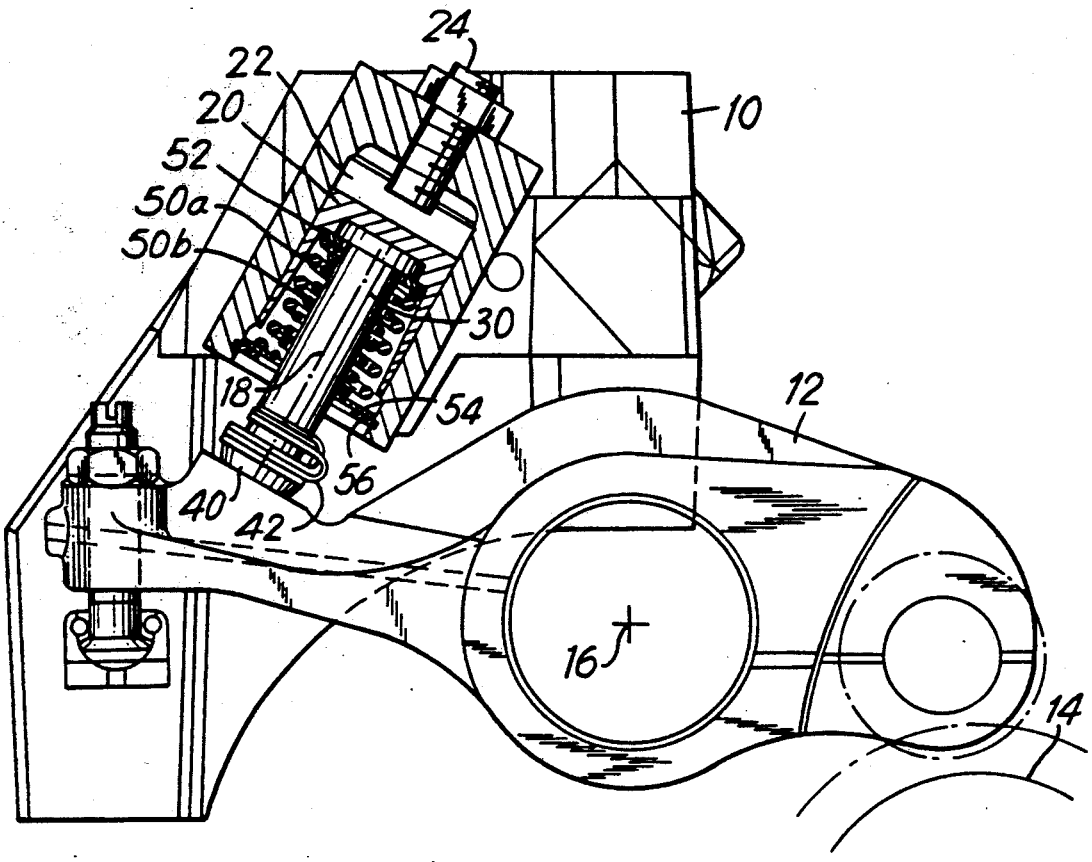
FIG. 2 is a view similar to FIG. 1 showing another operating condition of the apparatus shown in FIG. 1.

FIG. 2 shows rocker arm 12 displaced in the conventional manner by slave piston 20 as a result of the injection of high pressure hydraulic fluid into cylinder 22 above piston 20 from an associated master piston (not shown). In response to this high pressure hydraulic fluid, slave piston 20 moves down a short distance in cylinder 22 parallel to axis 18. This causes foot 40 to rotate rocker arm 12 by a small amount about the pivot axis 16 of the rocker arm. Because foot 40 does not slide on rocker arm 12 during this pivoting of the rocker arm, the foot 40 and the lower end of push rod 30 move through a short arc which is concentric with axis 16. This causes push rod 30 to pivot slightly out of alignment with axis 18.

Figure 3:
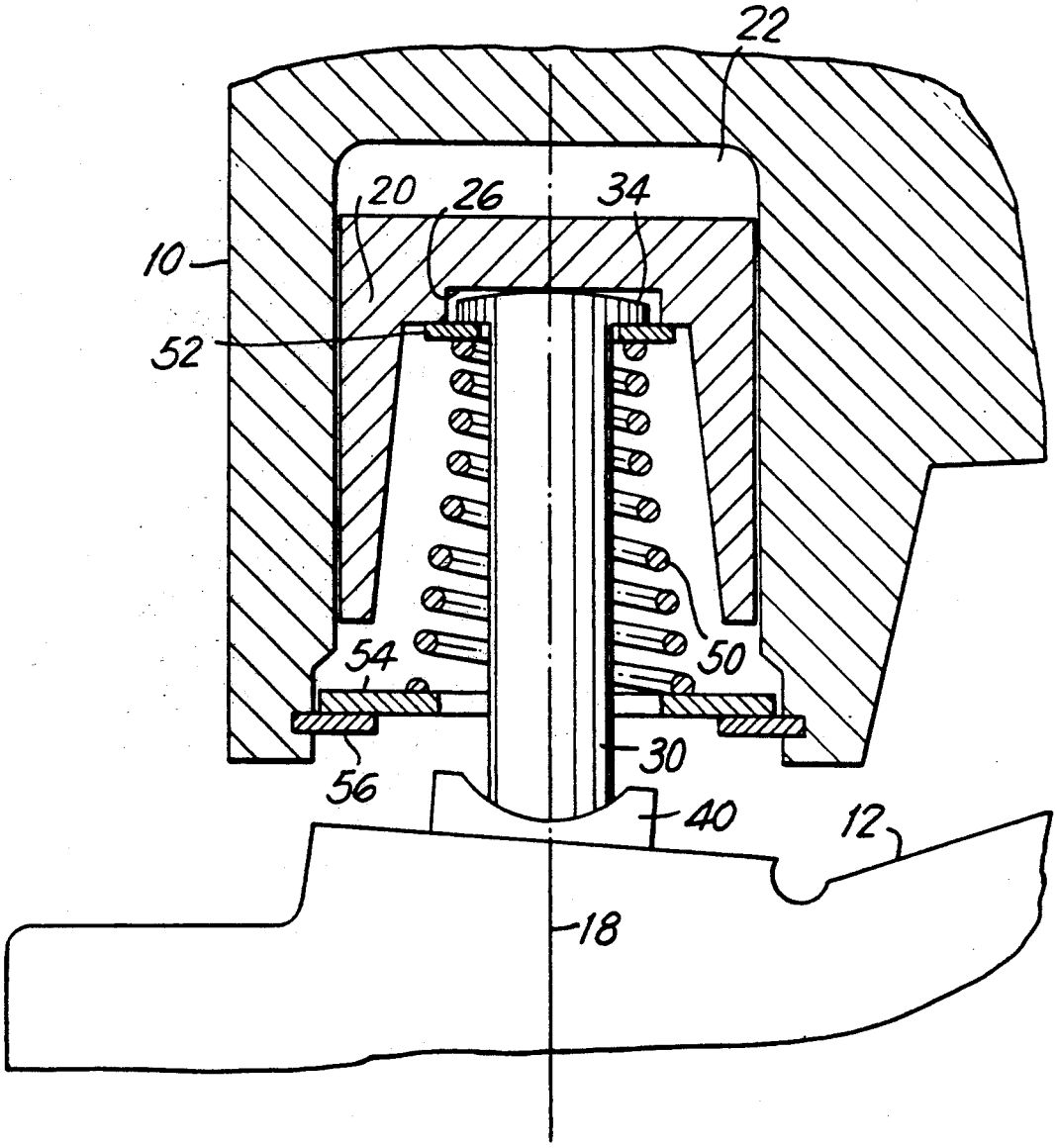
FIG. 3 is an even more simplified view of the apparatus shown in FIG. 1 with certain features greatly exaggerated to better illustrate the principles of this invention.
Figure 4:
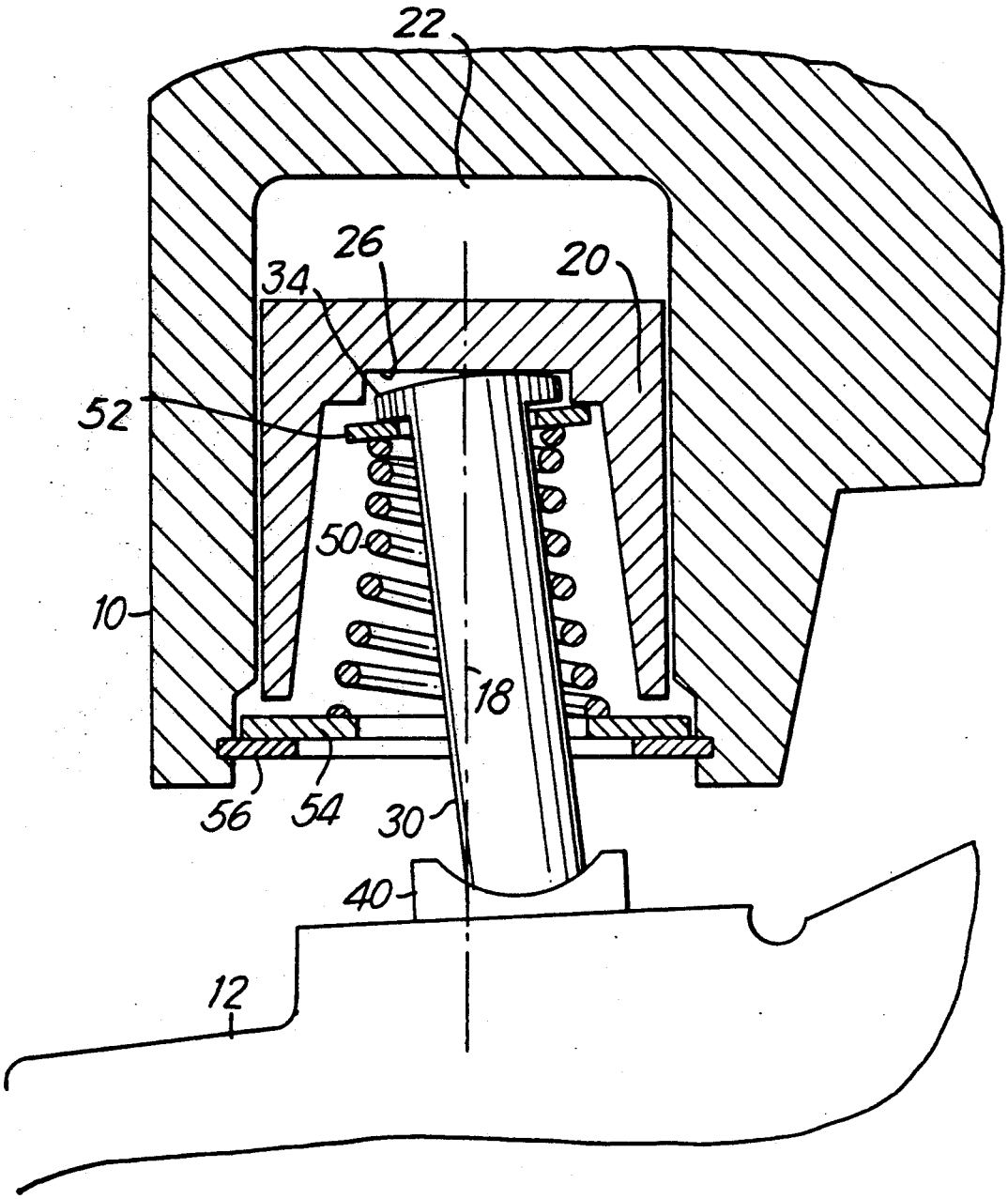
FIG. 4 is a view similar to FIG. 3 showing the operating condition shown in FIG. 2.

In accordance with this invention, to accommodate the above-described pivoting of push rod 30 while avoiding any sliding of the upper surface 34 (FIG. 3) of the push rod relative to the mating surface of piston 20, the upper surface of the push rod is made spherical with a relatively large radius, while the piston surface 26 in contact with that spherical surface is made flat. (See FIGS. 3 and 4 where the curvature of surface 34 and the pivoting of push rod 30 are exaggerated for clarity.) Accordingly, rather than sliding relative to surface 26 as is typical in the prior art, surface 34 rolls on surface 26. In the typical prior art apparatus by comparison, rod 30 has a relatively small diameter ball and socket joint with piston 20 (like the depicted ball and socket joint between rod 30 and foot 40). Accordingly, the mating surfaces in this prior art joint necessarily slide relative to one another when rod 30 pivots. This makes it necessary to give special attention to these surfaces (e.g., requiring that they be ground and polished). It is difficult and expensive to grind and polish the recessed surface of piston 20. Lubrication of such recessed surfaces is also difficult. By substituting the above-described rolling of surface 34 on surface 26 in accordance with this invention, it becomes unnecessary to grind and polish surface 26. Lubrication of these surfaces also becomes less important.

The radius of curvature of surface 34 is preferably chosen to be as large as possible without being so large that normal pivoting of push rod 30 causes the edge of surface 34 to contact piston surface 26. For example, a typical radius of curvature may be approximately 30 inches. A large radius is desirable to more widely distribute the stress of the contact between surfaces 26 and 34. Wide distribution of stress is also the reason why it is desirable to avoid contact between the edge of surface 34 and surface 26.

While it is believed that the easiest and cheapest way to achieve the above-described rolling contact between push rod surface 34 and piston surface 26 is to make surface 26 flat and surface 34 spherically convex, it will be appreciated that other possibilities within the scope of this invention exist. For example, surface 26 could be slightly spherically concave to increase the area of contact between surfaces 26 and 34 and thereby lower the contact stress. If this is done, however, the radius of curvature of concave surface 26 should be much greater than the radius of curvature of convex surface 34 so that surface 34 still rolls on surface 26 as described above, rather than sliding on that surface as in the prior art. Accordingly, if surface 26 is made concave as just described, the concavity will be so slight that surface 26 can still be characterized as substantially flat as that phrase is used in the appended claims. As another example of a modification within the scope of this invention, if push rod 30 were restrained from rotation about axis 18, surface 34 could be made cylindrically convex about an axis parallel to axis 16. As another possibility, surface 26 could be made spherically convex (or cylindrically convex about an axis parallel to axis 16 if piston 20 were restrained from rotation about axis 18) while surface 34 was made flat. As still another possibility, both of surfaces 26 and 34 could be made spherically convex (or with appropriate restraint of elements 20 and 30 as mentioned above, both of surfaces 26 and 34 could be made cylindrically convex about an axis parallel to axis 16). In all of these alternatives, the above-discussed considerations relating to choice of a relatively large radius of curvature are equally applicable. Thus in all of these embodiments the radius of the curved surface or surfaces is preferably as large as possible without causing the edge of a curved surface to come into contact with the opposing surface.

It will be understood that the foregoing is merely illustrative of the principles of this invention, and that various modifications can be made by those skilled in the art without departing from the scope and spirit of the invention. For example, the radius of curvature of the convex rolling surface can be varied to suit the geometry encountered in a particular application of the invention.

The invention claimed is:

1. Hydraulic piston apparatus for use in a compression release engine retarder for coupling the motion of a piston in the engine retarder which reciprocates along a reciprocation axis to the motion of an element in the engine associated with said retarder which pivots about a pivot axis which is transverse to said reciprocation axis, said apparatus comprising:

a push rod having a longitudinal axis which is generally aligned with said reciprocation axis, a first surface transverse to said longitudinal axis being associated with said push rod adjacent to said piston, and bearing means adjacent to the end of said push rod which is remote from said first surface for contacting said element so that said bearing means moves through an arc concentric with said pivot axis when said element pivots; and a second surface associated with said piston, said second surface being transverse to said reciprocation axis and in contact with said first surface, and one of said first and second surfaces being convex while the other of said first and second surfaces has a shape selected from the group consisting of substantially flat and convex.

2. The apparatus defined in claim 1 wherein said first surface is convex.

3. The apparatus defined in claim 2 wherein said second surface is flat.

4. The apparatus defined in claim 1 wherein said one of said first and second surfaces has a radius of curvature of approximately 30 inches.

5. The apparatus defined in claim 1 further comprising:

means for resiliently biasing said longitudinal axis into substantial parallelism with said reciprocation axis.

6. The apparatus defined in claim 5 wherein said means for resiliently biasing comprises:

means for resiliently urging said piston to move along said reciprocation axis in a direction away from said element.

7. The apparatus defined in claim 6 wherein said means for resiliently biasing comprises:

a third surface on said push rod;

a fourth surface on said piston;

a member in contact with both of said third and fourth surfaces when said longitudinal axis is parallel to said reciprocation axis; and a spring for resiliently urging said member into contact with both of said third and fourth surfaces.

8. The apparatus defined in claim 7 wherein said third and fourth surfaces are substantially concentric annular surfaces around said longitudinal axis which face toward said element and which are substantially parallel to one another when said longitudinal axis is parallel to said reciprocation axis.

9. The apparatus defined in claim 8 wherein said third and fourth surfaces are substantially coplanar when said longitudinal axis is parallel to said reciprocation axis.

10. The apparatus defined in claim 9 wherein said member has an annular fifth surface substantially concentric with said third and fourth surfaces, said fifth surface being in substantially annular contact with both of said third and fourth surfaces when said longitudinal axis is parallel to said reciprocation axis.

11. The apparatus defined in claim 5 wherein said piston reciprocates in a cylinder in said retarder, and wherein said means for resiliently biasing comprises:

prestressed compression coil spring means substantially concentric with said push rod, one end of said prestressed compression coil spring means bearing on said push rod and said piston, and the other end of said prestressed compression coil spring means bearing on a wall of said cylinder between said piston and said element.

12. The apparatus defined in claim 7 wherein said piston reciprocates in a cylinder in said retarder, and wherein said spring is a prestressed compression coil spring substantially concentric with said push rod and having one end which bears on said member opposite said third and fourth surfaces, and another end which acts on a wall of said cylinder between said piston and said element.

13. The apparatus defined in claim 1 wherein said bearing means comprises:

a foot pivotably mounted on the end of said push rod which is remote from said first surface.

14. The apparatus defined in claim 13 wherein said foot has a ball and socket connection to said push rod.

15. The apparatus defined in claim 13 wherein said foot is held to said push rod by a spring clip which is wrapped around both said push rod and said foot.

* * * * *